United States Patent [19]

Best et al.

[11] 3,955,387

[45] May 11, 1976

[54] CYLINDRICAL LOCK SET

[75] Inventors: Walter E. Best; R. Gene McCullum, both of Indianapolis, Ind.

[73] Assignee: Best Lock Corporation, Indianapolis, Ind.

[22] Filed: Nov. 14, 1974

[21] Appl. No.: 523,570

[52] U.S. Cl. ..... 70/224; 70/370; 70/451; 70/461; 70/462; 292/336.3; 292/347; 292/352

[51] Int. Cl.[2] ..... E05B 63/10

[58] Field of Search ..... 70/146, 147, 148, 224, 70/370, 377, 449, 451, 452, 461, 462; 292/337, 347, 352, 357, 336.3

[56] References Cited

UNITED STATES PATENTS

| | | | |
|---|---|---|---|
| 1,938,112 | 12/1933 | Schlage | 70/452 |
| 2,301,751 | 11/1942 | Schlage | 70/224 |
| 2,719,424 | 10/1955 | Rayburn | 70/224 |
| 2,848,264 | 8/1958 | Lynch | 292/347 |
| 2,998,274 | 8/1961 | Russell | 292/169 |
| 3,077,100 | 2/1963 | Gerlach | 70/224 |
| 3,190,091 | 6/1965 | Russell et al | 70/224 |
| 3,413,829 | 12/1968 | Russell | 70/224 |

*Primary Examiner*—Albert G. Craig, Jr.
*Attorney, Agent, or Firm*—Jenkins, Hanley & Coffey

[57] ABSTRACT

A heavy duty cylindrical lock set adaptable for various "functions" and having improved features, especially to permit a key-removable lock core to be reversible in its knob mounting to suit right- and left-hand doors. A knob sleeve of large diameter is slotted and shaped at its knob receiving end to form two diametrically-opposed channel sections of high strength and rigidity. The inward edges of the four channel side legs form a mounting seat to receive the key-plug-containing body of the core on the axis of the knob, while the two spaces between the channel sections permit the pin-tumbler lobe or section of the core to extend radially in either of two orientations about the axis of the knob. Two of the channel side edges are notched to engage a key-controlled retaining lug of the core. The knob has a large bore in its outer end and is supported from the knob sleeve by a drive ring which accomodates the core in both orientations. A face plate is held in the knob bore by the core and closes the knob bore. The same knob may be used on the inside of the door, with a similar lock core and face plate or with a different face plate, differently retained, according to the "function" for which the lock set is adapted. The locked knob is retained on the sleeve by a keeper engaged behind a heavy internal rib and blocked from retraction by the cylindrical shank of a throw member held in place by the key-removable core.

The inner end of the core-containing knob sleeve has a roll-back cam operable in one direction and contains a key release cam assembly having a roll-back cam operable in the other direction either by a key-actuated throw member or by the knob sleeve. The knob sleeve is of heavy section and is held against forceful withdrawal from the frame assembly both by the roll-back cam and by a spaced out-turned lug which rides in a groove in the hub below the level of the key-release roll-back cam.

The knob has an integral tubular neck which rotatably fits over the mounting hub of the chassis and which is neatly surrounded over a variable length by a collar on an axially adjustable escutcheon. The escutcheon is threaded on the hub and is locked in adjusted position by a plunger pin which latches in retracted position during escutcheon adjustment.

29 Claims, 13 Drawing Figures

Fig. 2
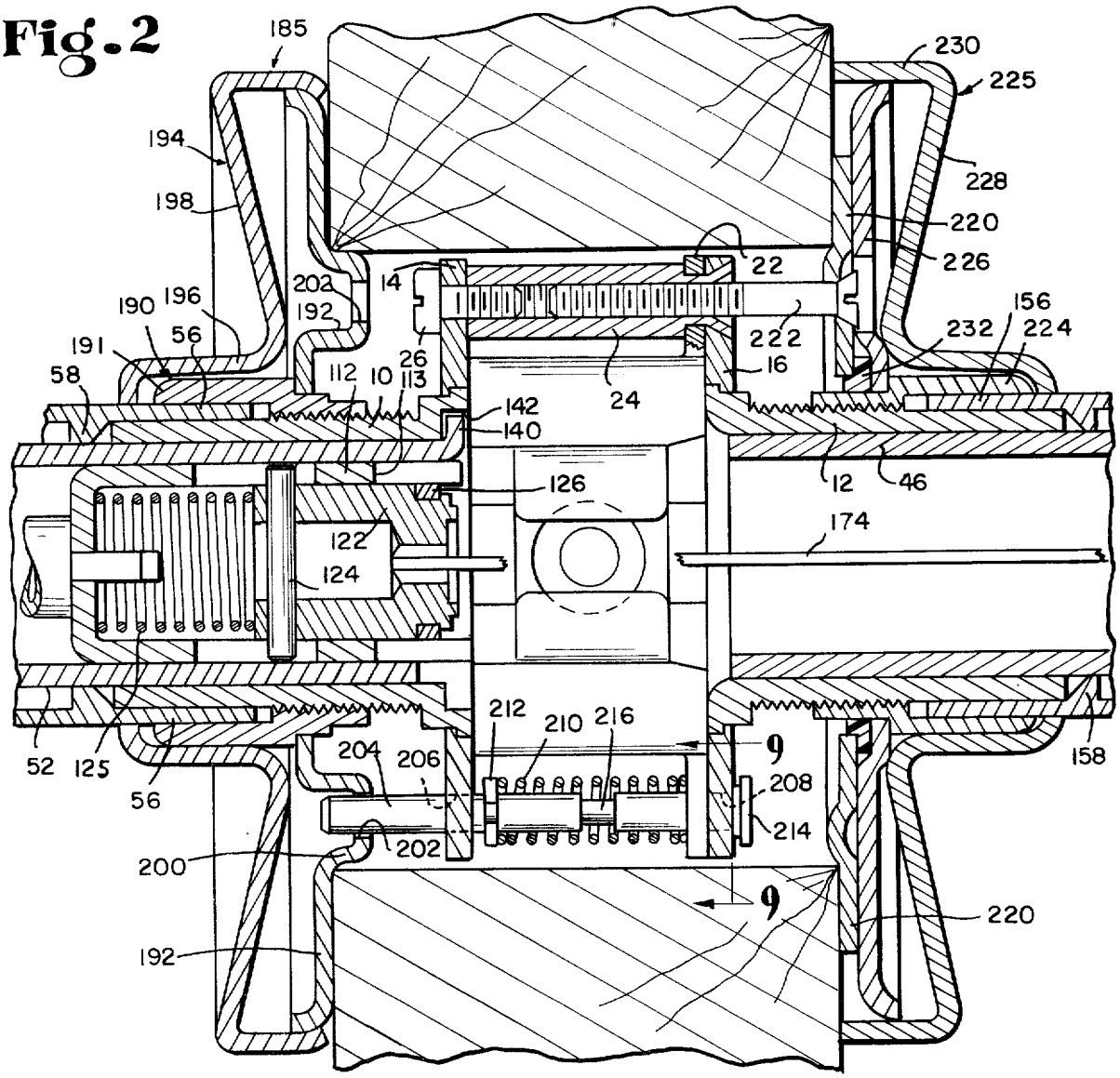
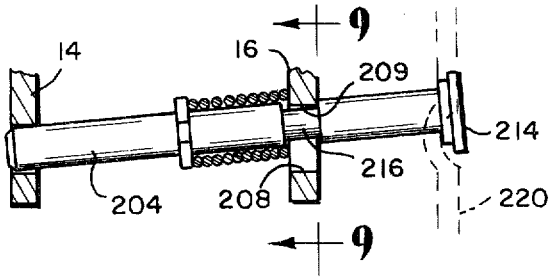
Fig. 8
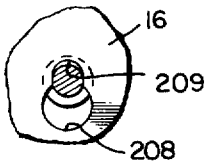
Fig. 9

CYLINDRICAL LOCK SET

BACKGROUND OF THE INVENTION

This invention relates to a cylindrical lock set which may be used with the deadlocking latch bolt mechanism of our copending application Ser. No. 390,847 filed Aug. 23, 1973.

The invention provides a cylindrical lock set adapted for heavy duty use, having an improved construction as compared to previously available lock sets, and formed of sturdy parts in a combination having a novel and improved features, including especially the feature of permitting a key-removable lock core to be mounted in either of two orientations with respect to the lock chassis so as to suit either right-hand or left-hand doors.

A lock set embodying the invention may have any of a number of different "functions," that is, may be of different types and operate differently to suit different applications. Such different functions may, for example, be as specififed for heavy duty bored lock and latch sets, Series 161, in U.S. Federal Specification for Builders Hardware, Locks and Door Trim, FF-H-00106 b (GSA-FSS) dated Aug. 21, 1967, more particularly the different functions identified by letter "type symbols" A, B, C, etc. in the table on pages 35–37 of that Federal Specification. For convenience, and by way of example, the lock set here shown and particularly described is an A function lock, but it is to be understood that this is illustrative only and that the invention may be embodied in modified structures which provide other functions.

SUMMARY OF THE INVENTION

The lock set embodying the invention comprises a sturdy chassis including two flanged hubs fixed to opposite sides of a retractor frame. The retractor frame contains a latch bolt retractor, and the chassis is adapted to be mounted in a transverse bore in a door stile with the rectractor engaged with a latch bolt mouonted in the edge of the door.

An outside knob sleeve is rotatably mounted in the outside hub and is adapted to receive in its outer end a key-actuated lock core having a key plug which rotates on the axis of the sleeve and centrally of the knob carried by such sleeve. The knob sleeve is a heavy-walled part of generally cylindrically shape and of substantially larger diameter than the key-plug section of the core. The outer end of the sleeve is slotted lengthwise, and the material between the slots forms two diametrically-opposed arms which are preferably shaped as channel sections of high strength and rigidity. Each channel has a peripheral web portion and two inward extending legs. The legs serve as spacers for mounting the core coaxially with the sleeve, and the inner edges of the four legs are dressed in a symmetrical pattern to fit and embrace the outer surface of the key-plug section or body of the core. The core is desirably a key-removable core having a key-retractable retaining lug projecting from one side, and is preferably a figure-8 shaped core as shown, for example, in U.S. Pat. No. 3,603,123. Two opposite channel legs of the sleeve are notched to engage the retaining lug of such core. The key-plug body of the core is slidably received co-axially in the larger knob sleeve, and the spaces between the two channel sections permit the pin-tumbler lobe or section of the core to lie in a radial position in either of two orientations, 180° apart about the axis of the knob and sleeve.

A knob is mounted over the sleeve. The knob is desirably machined from solid stock with a neck at its inner end telescopically received over the hub, and with a larger bore at its outer end sufficient to clear the core in both orientations. The outer end of the knob is supported from the knob sleeve by a locating drive ring keyed to both parts so as to transmit knob torque to the sleeve. The knob drive ring is apertured to permit both orientations of the core. A face plate is mounted in the outer end of the knob to close the outer end of the knob bore, and may be held in place by the core or may be fixed in the knob. The same knob may be used on the inside of the door, either with or without a core and with either a similar or different face plate, depending on the function for which the lock is intended.

The knob is held on the knob sleeve by a keeper mounted in the knob sleeve and engaged against an internal rib in the neck of the knob, and such keeper is blocked from retraction by a cylindrical shank on a throw member held by the core. Also, the core, by its engagement with the knob sleeve, blocks removal of the knob from the knob sleeve.

The inner end of the outside knob sleeve carries a roll-back cam operable in one direction to actuate the bolt retractor. A key-actuated cam carrier is rotatably mounted in the knob sleeve and carries a second roll-back cam operable in the opposite direction either by the knob sleeve or independently by the key-actuated throw member.

The knob sleeve is held against forceful withdrawal from the frame assembly both by the bearing of its roll-back cam against the inner end of the hub, and by a circumferentially-spaced, out-turned lug which rides in a groove in the hub below the level of the key-actuated roll-back cam.

The lock set is mounted in a door by means of an outside escutcheon bearing against the outside of the door, and by an inner clamp plate bearing against the inside of the door and covered by an inside escutcheon. The escutcheons are threaded on the hubs and are axially adjustable to fit doors of different thicknesses and to center the retractor with the bolt. The outside escutcheon is locked in adjusted position by a plunger pin mounted on the chassis, which latches in retracted position during escutcheon adjustment.

The knob mounting and escutcheon combine to provide an advantageous and pleasing assembly. Thus, the knob is supported at its outer end by the knob sleeve which is rotatably mounted inside the hub, and is supported at its inner end by a long neck which is rotatably received over the outside of the hub. The inner rib at the outer end of the neck bears against the end of the hub to take inward thrust, and is engaged by the knob retainer to transmit outward pull to the knob sleeve. The escutcheon threaded on the hub has a long collar which telescopes over the knob neck for a considerable length and allows a long range of esscutcheon adjustment without opening the joint between them. The knob is thereby held for firm and smooth operation in heavy duty use, while its neck-shape merges neatly with that of the escutcheon with but a single break line between them in all positions of adjustment and with no need for a trim ring as commonly employed.

BRIEF DESCRIPTION OF THE DRAWINGS

The accompanying drawings illustrate the invention and show by way of example a preferred embodiment as constructed to provide a so-called A function. In such drawings:

FIG. 2 is a partial longitudinal section of the lock set of FIG. 1, taken in a vertical plane, on the line 2—2 of FIG. 3;

FIG. 8 is a fragmental view of the escutcheon locking pin mechanism appearing at the bottom of FIG. 2, shown with the pin in retracted position;

FIG. 9 is a fragmental transverse section, taken on the line 9—9 of FIG. 2 and FIG. 8;

DETAILED DESCRIPTION OF THE PREFERRED EMBODIMENT

Figure 4:
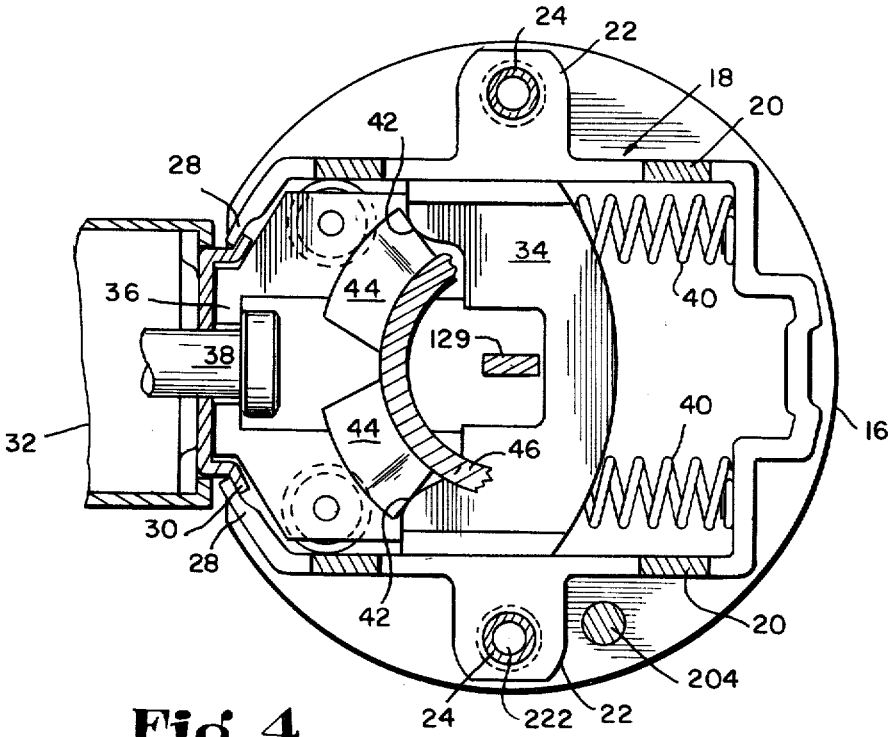
FIG. 4 is a transverse section, on the line 4—4 of FIG. 1.

The cylindrical lock set shown in the drawings is arranged to have the so-called A function for use in an entrance or office door lock and providing a key lock in the outside knob and a manual locking device in the inside knob. Such lock set comprises a chassis 8 consisting of two hubs 10 and 12 having wide flanges 14 and 16 at their inner ends which form side plates that are fixed to the edges of a retractor ffame 18. The frame 18 has laterally projecting ears 20 at its side edges which are received in notches in the side plates 14 and 16. As shown in FIGS. 2 and 4, the frame also has two out-turned ears 22 which lie against the inner face of the side plate 16 and are riveted thereto by the ends of hollow clamp studs 24. The opposite side plate 14 is held against the opposite side of the frame 18 by cap screws 26 screwed into the ends of the studs 24. The opposite ends of the studs 24 remain open to receive clamp screws described below.

As shown in FIG. 4, the forward end of the frame 18, to the left in FIG. 4, has its wall edges arranged to form a pair of spaced jaws 28 adapted to engage with ears 30 at the rear of a latch bolt housing 32, such as that of our copending application Ser. No. 390,857. The frame 18, contains a retractor 34 having jaws 36 at its forward end for engaging with the tail piece 38 of the latch bolt in the housing 32. Such retractor 34 is spring pressed forward by a pair of springs 40 seated against the backwall of the frame 18. At each side, the retractor 34 carries a pair of rollback cam faces 42, and as shown in FIG. 4, those toward the inside of the door are engaged by the roll back cams 44 of the inside knob sleeve 46 described below. Rotation of the knob sleeve 46 in either direction carries a rollback cam 44 against a cam face 42 to retract the retractor 34 and thereby retract the latch bolt by its tail piece 38.

An outside knob 50 is carried by a knob sleeve 52 rotatably mounted in the outside hub 10. The knob 50 has a hand-hold portion 54 at its outer end and a neck 56 at its inner end, telescopically received over the hub 10 and rotatably thereon. Near the outer end of the neck 56, the knob has an inner flange 58 having a front beveled face which bears against the outer end of the hub 10. The knob is held against retraction from the hub 10 by a keeper 60 projecting through an opening 61 in the side wall of the knob sleeve 52 and engaged against the outer face of the flange 58. The opening 61 is cruciform, the keeper 60 is held in its side arms, and the spring 62 lies in its end arms. The outer face of the keeper is beveled to ride over the beveled rib 58 as the knob is assembled on the sleeve 52, and the knob has an access opening 63 opposite the end of the keeper to permit insertion of a release tool. The keeper 60 is normally spring-pressed outward by a leaf-spring 62, and is normally blocked from retraction by the cylindrical shank 64 of a throw member 66 which is removable only after first removing the key-controlled lock core as described below.

The knob 50 is desirably machined from solid stock, and has a large bore 68 in its outer end which will be referred to below and which facilitates the machining of the knob.

Figure 5:
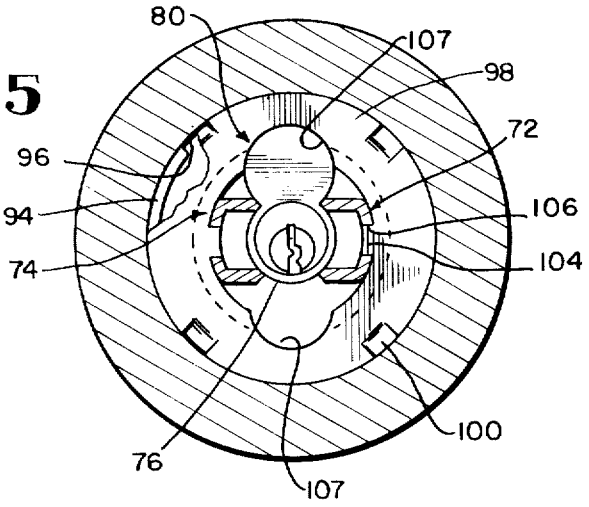
FIG. 5 is a transverse section through the outside knob, taken on the line 5—5 of FIG. 1.
Figure 6:
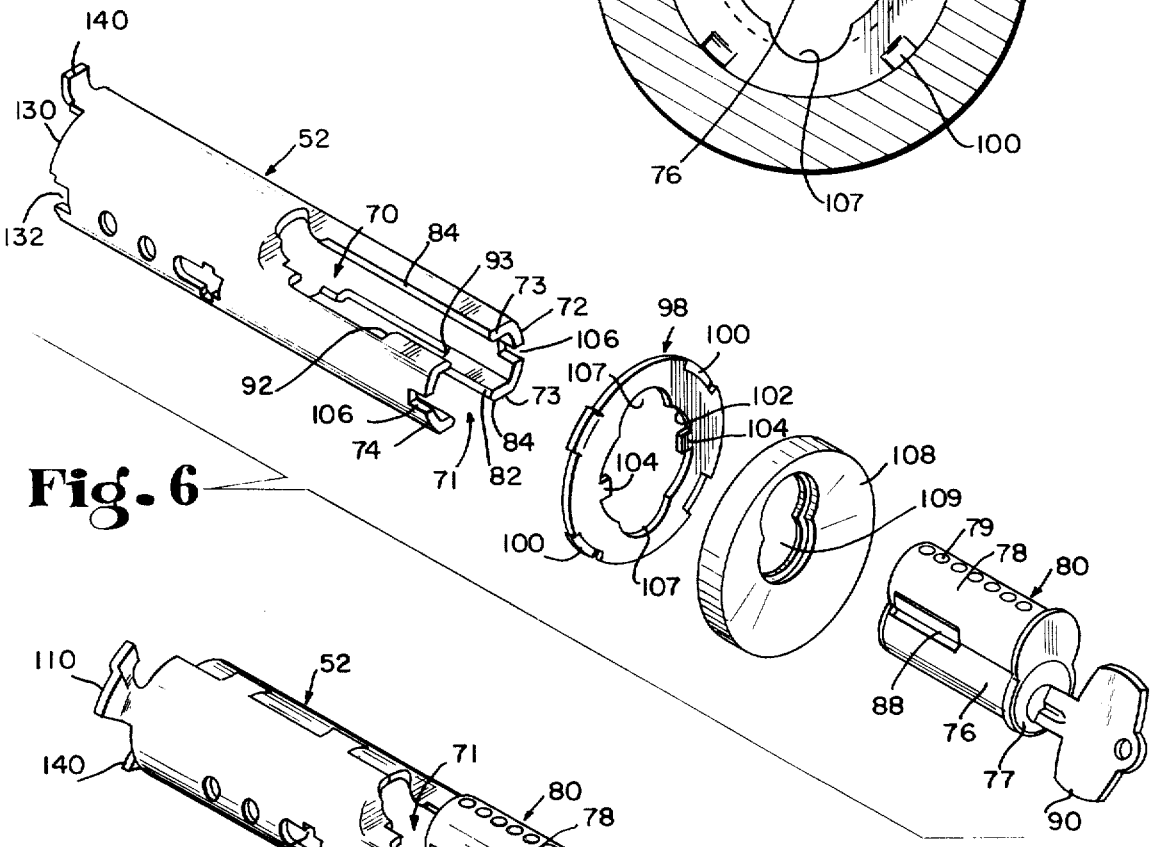
FIG. 6 is an isometric exploded view showing the outside knob sleeve construction and its associated parts with the knob sleeve turned to receive the core in one orientation.
Figure 7:
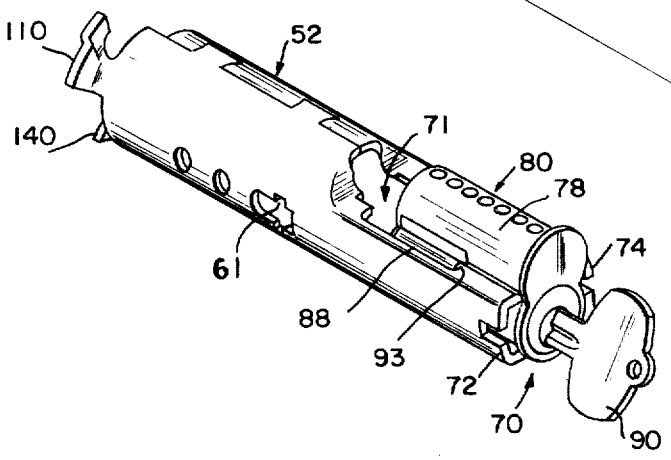
FIG. 7 is an isometric view showing the knob sleeve turned 180° from its position in FIG. 6 and showing the knob assembled therewith in an orientation 180° from that in FIG. 6.

As shown in FIGS. 5, 6 and 7, the knob sleeve 52 is a generally cylindrical tube which may be formed from flat stock stamped and rolled to shape. Its outer end is formed with two diametrically opposite slots 70 and 71, and the remaining wall portions are shaped to form two diametrically-opposed channel sections 72 and 74. The side legs 73 of the two channel sections extend inward in two chordal planes, and their inner edges are dressed to fit and embrace the lower lobe 76 of a key-removable core 80. Such core may be of figure-8 cross section having a lower lobe 76 containing a key plug 77 and having an upper lobe 78 containing a row of pin tumblers mounted in bores 79.

As shown in FIGS. 5 and 6, the inner edges of the channel sections 72 and 74 are each formed with two bevels. The inner bevels 82 are shaped and positioned to mate with the cylindrical surface of the lower lobe 76 of the core 80, while the outer bevels 84 fit against the cylindrical outer surface of the upper lobe 78 of the core at the bottom of the grooves where such surface joins the surface of the lower lobe 76.

The core 80 is retained in position by a lug 88 which normally projects through the side of the core and is retractable by use of a special control key 90. To provide for engagement of the lug 88 in the knob sleeve 52, the upper left and lower right beveled edges of the pair of channel sections 72 and 74 are notched to form shoulders 92 and 93 behind which the lug 88 of the core 80 can be engaged to prevent retraction of the core 80 from the knob sleeve.

The two channel sections 72 and 74 are symmetrical about the central axis of the knob sleeve so that they are adapted to receive the core 80 in either of two orientations. As shown in FIGS. 5 and 6, the sleeve is oriented with the slot 70 at the top, and the tumbler pin lobe 78 of the core is upward and extends through that slot 70 at the top of the knob sleeve, and the core-retaining lug 88 engages the shoulder 92 on the channel 74. Alternatively, for a door of opposite hand, the chassis and the sleeve 52 will be inverted so that the slot 71 of the sleeve is at the top, as shown in FIG. 7. In this inverted orientation of the sleeve, the core 80 can again be mounted in upright position, with the key-plug lobe 76 engaged between the channel sections 72 and 74 but with the tumbler lobe 78 in the slot 71 which is not at the top. The lug 88 now engages the shoulder 93 on the channel section 72 instead of the shoulder 92 on the channel section 74.

The arrangement permits the core 80 to be mounted in upright position in the knob sleeve 52 regardless of the hand of the door in which the lock set is mounted, and changing the orientation of the core in the knob sleeve is easily accomplished by simply removing the core, turning it over and reinserting it in the sleeve in its new orientation. As will appear, such reversal in a finished lock set is accomplished without removing the knob.

The knob sleeve 52 is of substantially larger diameter than the lobe 76 of the core 80, and the two channel sections 72 and 74 form structural members of high strength and rigidity so as to withstand forceful tampering with the lock set and knob.

Figures 1, 1A, 11, 12:
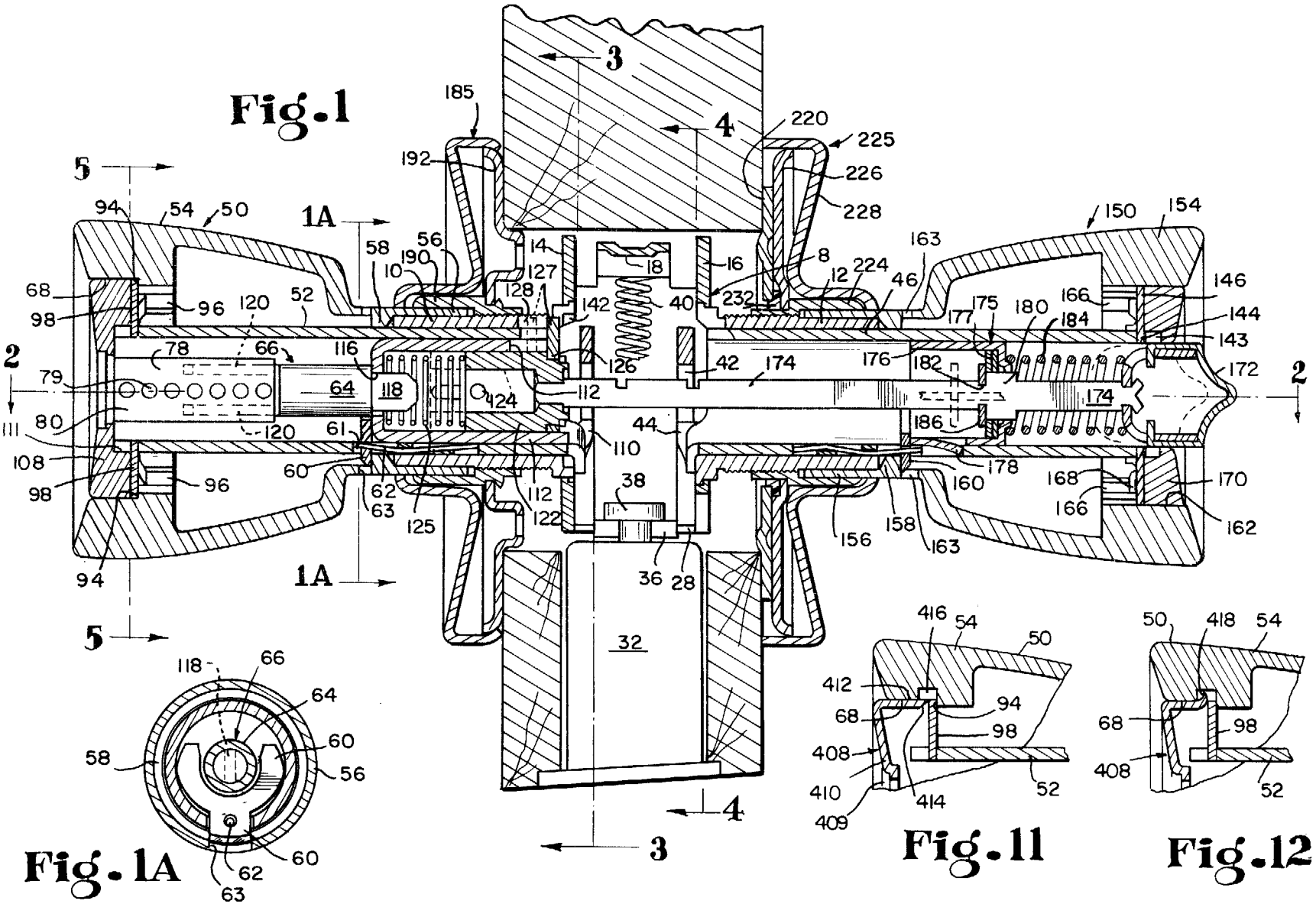
FIG. 1 is a longitudinal section through a cylindrical lock set embodying the invention, taken in a horizontal plane, on the line 1—1 of FIG. 3.
FIG. 1A is a partial section, on the line 1A—1A of FIG. 1.
FIGS. 11 and 12 are partial sections of a knob, showing a modified face plate in partial and fully assembled positions.

The outer end of the knob 50 is supported from the outer end of the knob sleeve 52, in an arrangement which permits the two alternative orientations of the core 80 in the knob 50. As previously mentioned and as shown in FIGS. 1 and 5, the outer end of the knob 50 contains a large bore 68, of a radius substantially larger than the distance from the center of the key plug 77 to the top of the pin tumbler lobe 78. The bore 68 is formed with an outward-facing shoulder 94 intermediate its length, and the bore is of smaller diameter inward of such shoulder. The smaller diameter portion is broached with four axial slots 96. A knob retainer or drive ring 98 is positioned in the bore 68 against the shoulder 94. As shown in FIG. 6, such drive ring 98 has four tabs 100 offset from the plane of the ring. These engage in the slots 96 when the ring 98 is positioned in the knob, to fix the drive ring 98 against rotation and axially in that knob. The center of the drive ring 98 contains a circular opening 102 adapted to fit over the outer cylindrical surfaces of the webs of the two channels 72 and 74, and two tongues 104 extend inward from the periphery of such opening to engage in notches 106 formed in the channels 72 and 74, to fix the drive ring 98 against rotation and axially on the knob sleeve 52. The central opening 102 of the drive ring 98 also has upper and lower extensions 107 to provide clearance for the pin tumbler lobe 78 of the core 80 in either of its two orientations with respect to the knob sleeve 52.

The outer end of the bore 68 of the knob 50 is closed by a face plate 108. As shown in FIG. 6, this has a figure-8 shaped opening 109 mating with the shape of the core 80, with the inner lobe of such opening coaxial with the knob 50 and sleeve 52. The back side of the face plate 108 has a counter-bore 111 (FIG. 1) of a diameter to fit over the generally cylindrical outer end of the knob sleeve 52. The face plate opening 109 is formed with a front peripheral groove to receive a front flange on the core 80, and the face plate is retained in the knob by the core 80.

With this arrangement, the lock set is adapted to be mounted in orientations for either a right-hand or left-hand door without modification except only the removal and reinsertion of the face plate and core. When the lock set is to be modified for a door of opposite hand, the control key 90 is operated to retract the retaining lug 88 from behind the shoulder 92 or 93, and the core 80 and the face plate are then free and can be retracted from the knob and knob sleeve. The core and face plate are then inverted, and reinserted in the knob and locked in place by manipulating the control key 90 to advance the retaining lug 88 into engagement behind the appropriate shoulder 92 or 93.

Figure 3:
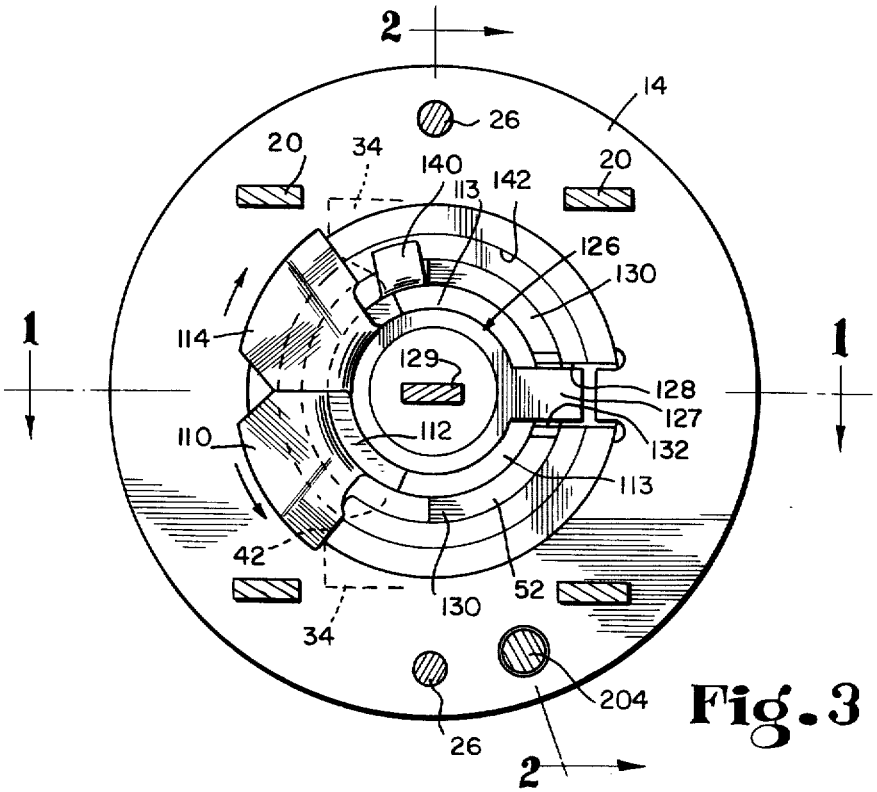
FIG. 3 is a transverse section on the line 3—3 of FIG. 1.

The inner end of the outside knob sleeve 52 is formed with a roll-back cam 110. (FIGS. 1, 3, and 7). As shown in FIG. 3, this extends from the plane of FIG. 1 (line 1—1 in FIG. 3) counterclockwise through somewhat more than 50°, and its counter-clockwise end is offset axially to lie in the plane of the retractor cam face 42 at this side of the retractor 34, shown in dotted lines in FIG. 3. Counter-clockwise rotation of the knob sleeve 52 by the knob will thus roll back the retractor 34 to retract the bolt tail piece 38.

A key actuated roll-back sleeve 112 is rotatably mounted within the inner end of the knob sleeve 52. As shown in FIG. 3, this carries a key-actuated roll-back cam 114 which extends from the plane of FIG. 1 (line 1—1 in FIG. 3) clockwise somewhat more than 50°, and its clockwise end is offset outward into the plane of the cam face 42 of the retractor 34, shown in dotted lines in FIG. 3. The adjacent edges of the knob roll-back cam 110 and the key-actuated roll-back cam 114 lie in abutting relation, so that clockwise rotation of the knob sleeve 52 will cause its roll-back cam 110 to thrust the key actuated roll-back 114 clockwise to roll back the retractor.

The key actuated roll-back cam sleeve 112 has an end wall at its outer end (FIG. 1) and this is provided with a transverse slot 116 which receives the flat end 118 of the throw member 66. The opposite end of the throw member 66 carries a pair of legs 120 which are received in spaced bores in the rear end of the key plug 77 of the core 80. The cylindrical shank 64 of the throw member 66 is held between the rear end of the core 80 and the front end of the key actuated roll-back sleeve 112. As previously mentioned and as shown in FIG. 1A, such shank lies in the path of retraction of the knob keeper 60 to prevent retraction of that keeper when the throw member 66 is in place.

For purposes of locking the knob sleeve 52 and the out-side knob 50 against rotation, and thus to limit lock actuation to that provided by the key actuated core 80, a locking lug bushing 122 (FIGS. 1 and 2) is slidably mounted within the key-release roll-back sleeve 112. This is held against rotation in the sleeve 112 by a cross-pin 124, but is free to slide axially against a biasing spring 125. The end of the bushing 122 carries a locking lug 126 having an annular inner portion rotatably fixed on the end of the bushing 122, and having a radial lug portion 127. This radial lug portion, in its release position shown in full lines in FIG. 1, extends across a cut back end face 113 of the cam sleeve 112, across an inward offset end face 130 at the end of the knob sleeve 52 and into a slot 128 at the inner end of the hub 10 of the lock chassis. It is thereby to the hub 10 and against rotation therein, but leaves the sleeve 112 and 52 free to rotate. As shown in FIG. 6, the end of the knob sleeve 52 is cut away to form the inward offset end face 130. The sleeve 112 is similarly cut back over a portion of its circumference spaced from the roll-back cam 114 (FIGS. 1 and 3). As shown in FIG. 3, the inward offset end surfaces 130 and 113 extend through the entire 180° to the right of the vertical center line in FIG. 3. At the 90° position along the end surface 130, the knob sleeve 52 is provided with a notch 132, best seen in FIG. 6. When the locking lug 126 is moved axially from the full line position shown in FIG. 1 leftward to the dotted line position shown in FIG. 1, the lug portion 127 moves into such notch 132, and thereby locks the knob sleeve 52 to the hub 10 and prevents rotation of the knob sleeve 52. Movement of the locking lug 126 to such locking position is effected by thrusting the bushing 122 outward, to the left in FIGS. 1 and 2. In an A function lock, here shown, thrust for this purpose is exerted through a locking bar 174 from a button in the inside knob, described below.

The knob sleeve 52 is held in position in the hub 10 of the lock chassis, especially against outward pull, in part by the out-turned roll-back cam 110. This cam over most of its circumferential extend bears against the inner end face of the hub 10 and against the adjoining face of the side plate 14 (FIGS. 1 and 3). To supplement and reinforce the holding action provided by such roll-back cam 110, the end of the knob sleeve 52 also carries an out-turned lug 140, seen in FIGS. 2, 3, 6 and 7. This lies in a rabbet groove 142 formed by a shallow counter-bore in the inner end of the hub 10, and thus lies in a plane offset from and below the plane of the roll-back cam 114. The lug 140 is circumferentially spaced from the knob roll-back cam 110, as shown in FIG. 3, and cooperates with that roll-back cam 110 to provide support against outward pull on the knob sleeve 52 over circumferentially spaced areas.

The hub 12 at the inside of the door is similar to that at the outside of the door. See FIGS. 1, 2 and 4. It consists of a threaded tubular member having an out-turned flange at its inner end, assembled in a mating opening in the side plate 16 which forms a large flange for the hub. As shown in FIGS. 2 and 4, the side plate 16 is located on the frame 18 of the chassis by lugs 20 and fixed thereto by two clamp studs 24, whose reduced ends pass through the ears 22 of the chassis frame 18 and are flared in conical holes in the side plate 16 to form rivets securing the side plate 16 to such ears and to the frame 18.

The outside knob sleeve 46 is rotatably mounted in the tubular hub 12, and carries at its inner end two-turned roll-back cams 44. See FIGS. 1 and 4. The outer ends of such cams 44 are offset into the plane of the cam faces 42 on the retractor 34, and engage those cam faces as shown in FIG. 4 so that rotation of the knob sleeve 46 in either direction will drive the retractor 34, in a retracting direction.

The outer end of the knob sleeve 46 is of tubular configuration with a pair of diametrically opposite notches 143 therein for the reception of tongues 144 of a knob drive ring 146. The inside knob 150 is preferably identical with the outside knob 50, and includes an outer hand-hold 154, an inner neck 156 which is telescopically received over the hub 12, and an inwardly extending beveled rib 158 which bears against the end of the hub 12. Such rib 158 is engaged by a keeper 160 mounted transversely in the knob sleeve 46 and spring pressed outward to knob-retaining position. The neck has an access hole 163 opposite the end of the keeper for insertion of a release tool. The outer end of the hand-hold 154 contains a large bore 162 having a shoulder formed intermediate its length. Four circumferentially spaced notches 166 extend axially from the shoulder inward to the hollow cavity of the knob. The knob is supported from the outer end of the knob sleeve 46 by the knob drive ring 146 which fits within the bore 162 and against the shoulder therein, and which has an inner collar closely surrounding the cylindrical knob sleeve 46. As mentioned above, the drive ring is keyed to the knob sleeve 46 by the tongues 144 extending into notches in the sleeve. It is keyed at the outer periphery to the knob by means of inward offsets 168, like the offsets 100 of the drive ring 98 shown in FIG. 6, and these engage in the notches 166 in the knob. The open bore 162 of the knob 150 is closed by an annular face plate 170 which has an interference fit in the bore 162.

For purposes of locking the outside knob 50 against rotation, a turn button 172 is slidably and rotatably mounted within the tubular open end of the inside knob sleeve 46 and within the central opening of the face plate 170. This is fixed at its inner end to a locking bar 174 which extends axially through the knob sleeve 46 and the retractor chassis to the locking lug bushing 122.

The axial positioning and turning of the locking bar 174 is controlled by a detent assembly 175 intermediate the knob sleeve 46. This includes a detent cup 176 bearing against the knob keeper 160 and locked against outward movement by an out-turned tab 178. At this point in the length of the locking bar 174, it is widened to form a pair of ears 180, and is formed therebelow with a narrow section 182. The cut 176 contains a detent plate 177 which engages the ears 180 to prevent rotation of the locking bar 174 in its outward position as shown in full lines in FIG. 1. The locking bar and turn button are spring pressed to this outward position by a spring 184 acting between the cup 176 and the turn button 172. A bar stop plate 186 is mounted on the narrow portion 182 of the locking bar and moves against the detent plate to act as a stop for outward movement of the locking bar and turn button. In its outward position, the turn button 172 is prevented from rotation by the action of the ears 180 engaged in the detent plate. However, the arrangement is such that the turn button can be thrust inward to carry the ears 180 past the detent plate, and the turn button can then be rotated 90° to carry its ears 180 into a locking position to hold the locking bar in inward position, as shown in dotted lines in FIG. 1.

As the locking bar is pushed inward, it moves the bushing 122 outward in the outside knob sleeve 52, and this carries the locking lug 126 from its full line position in FIG. 1 to its dotted line position, where it engages in the notch 132 in the outside knob sleeve 52 to lock that knob sleeve against rotation. Thus by pushing inward on the turn button 172 and rotating it 90°, it acts to lock the outer knob sleeve 52 and knob 50 against rotation.

The lock set is mounted in a door by means of two escutcheon assemblies. As shown in FIG. 2, the outer escutcheon 185 comprises an inner sleeve or ring 190 with its inner end internally threaded and engaged on the external threads of the hub 10. This carries an escutcheon liner 192 which fits about a machined surface on the sleeve 190 and is secured in place, as by staking. An outer decorative escutcheon facing 194 is mounted over the sleeve and liner assembly. The sleeve 190 includes an outward portion 191 which telescopes over the neck 56 of the knob, and the escutcheon facing 194 includes a tubular collar portion 196 surrounding the sleeve 190 and extending into close-clearance relation with the knob neck 56. The facing also includes an annular web portion 198, which leads to an outer rim which overlaps the outer edge of the liner 192 and is desirably crimped thereto.

The escutcheon assembly is adjustable axially of the hub 10 as needed to suit the door thickness and to position the chassis of the lock set centrally of the door and in alignment of the bolt assembly 32. The escutcheon assembly is locked in adjusted position by a locking pin 204 shown at the bottom of FIG. 2. The escutcheon liner 192 has an inward-offset ring portion 200 which is provided with a series of angularly spaced openings 202. The locking pin 204 is slidably mounted in aligned holes 206 and 208 in the chassis side plates 14 and 16. The pin is spring pressed towards the ring 200 by a spring 210 acting between the side plate 16 and a ring 212 fixed on the pin 204. The opposite end of the pin carries a head 214 which bears against the side plate 16 when the pin is in fully extended position.

Provision is desirably made to latch the pin in retracted position during rotation of the escutcheon assembly for adjustment on the threads of the hub 10. To this end, the pin is provided with an annular groove 216 intermediate its length, and the hole 208 is provided with a side slot 209 as shown in FIG. 9. The pin 204 is withdrawn manually by its head 214 until the groove 216 aligns with the side slot 209, and the pin is then moved laterally as shown in FIG. 8 to engage the outer shoulder of the groove 216 against the edges of the side slot 209. This latches the pin in retracted position and allows the escutcheon assembly to be freely rotated to its desired adjusted position. The retracted position of the pin 214 disposes its head in interference relation with the clamp plate 220 mentioned below, as shown in dotted lines in FIG. 8, so that such pin must be released before the clamp plate can be installed. When the pin is released, it locks the escutcheon in its adjusted position.

The liner 192 of the adjusted outside escutcheon 185 serves as one clamp plate for clamping the lock set in the door. An opposite clamp plate 220 is positioned against the opposite side of the door, and is clamped to the chassis by clamp screws 222 which are threaded into the two clamp studs 24. The clamp plate 220 is applied with the inside knob 150 and the inside escutcheon assembly removed, so that access may be had to the clamp plate 220 and the screws 222.

After the lock set has been clamped in the door, with the liner 192 of the outside escutcheon assembly bearing against the outer face of the door and the clamp plate 220 bearing against the inside face of the door, the inside escutcheon assembly 225 is then threaded onto the outside hub 12. Such inside escutcheon assembly comprises a sleeve 224 having internal threads at its inner end to engage the threads on the hub 12, and having an outer portion which telescopes over the neck 156 of the inside knob. Such inner sleeve 224 carries an escutcheon liner 226 which is mounted against a shoulder on the sleeve 224 and is staked in place. This is covered with a decorative outer escutcheon facing 228 which has a collar portion surrounding the inner sleeve 224, a web portion joined thereto and extending to the periphery, and a peripheral wall 230 which is engaged over the edge of the liner 226. Desirably, the escutcheon liner 226 is formed at its inner edge to provide a groove for the reception of a resilient locking ring 232 which is compressed into locking relation between the clamp plate 220 and the escutcheon liner 226 when the escutcheon assembly is threaded inward to its mounted positions against the side face of the door.

After the outside escutcheon assembly has been mounted in place, the knob 150 is installed on the knob sleeve 46. The knob carries the drive ring 146 and face plate 170. Installation is accomplished by placing the neck 156 of the knob 150 over the knob sleeve 46 and moving the knob inward to its seated position. As it approaches such position, the inward face of the rib 158 in the knob neck will engage the face of the keeper 160. Such faces are beveled so that the rib will cam the keeper inward to allow the rib 158 to move past such keeper. The keeper willl then move outward to lock the knob in place.

Use of the lock set shown in the drawings is as follows. For installation, the inside knob 150, the inside escutcheon assembly 225, and the inside clamp plate 220 are disassembled from the chassis. The outside knob 50 and the outside escutcheon assembly 185 are desirably assembled with the chassis at the factory, and need not be removed. Appropriate holes are bored in the door for the reception of both the latch bolt assembly 32 and chassis 8 of the lock set. The bolt assembly 32 is first inserted from the edge of the door. The chassis assembly is then inserted from the outside through the cross-hole in the door. As shown in FIG. 4, the jaws 28 of the chassis frame 18 are engaged with the ears 30 on the latch bolt housing 32, and the jaws 36 of the retractor 34 are engaged with the tail piece 38 of the latch bolt assembly. The locking pin 204 for the outside escutcheon 185 is retracted and latched in retracted position as shown in FIG. 8. The outside escutcheon 185 is then rotatably adjusted on the threads of the outside hub 10 to position the inner face of its liner 192 against the side face of the door when the chassis is centered between the faces of the door and in alignment with the latch bolt housing 32. The clamp plate 220 is then applied to the opposite face of the door and secured with the two clamp screws 222. The inside escutcheon assembly 225 is then threaded onto the inside hub 12, to carry such escutcheon 225 tightly against the face of the door. The inside knob 150 is then installed by engaging its neck over the inside knob sleeve 46, orienting it to align the lugs on the drive ring 146 with the notches 143 in the end of the knob sleeve, and thrusting the knob inward to carry its retaining rib 158 behind the keeper 160. The outer face plate 170 and the drive ring 162 are carried with the knob, so that these parts are carried into place as the knob is installed.

In different installations, the position of the lock set in space will differ, depending upon whether the door is a right-hand or a left-hand door. In FIG. 1, the outside of the door is to the left, and this disposes the parts shown in FIG. 6 in the orientation there shown. That is, the slot 70 between the side channels 72 and 74 is at the top, and when the core 80 is inserted between the side channels 72 and 74 of the knob sleeve 52 the tumbler lobe 78 of the core is upward, so that it appears in elevation in FIG. 1. If the door is of opposite hand, then the outside of the door will be at the right in FIG. 1, and the lock set, when properly installed, will be turned over, and this would position the tumbler lobe 78 of the core at the bottom. This places the core in an upside-down position which is undesirable. It can be easily corrected. To correct it, the control key 90 is inserted in the core 80 and rotated a short distance clockwise to retract the retaining lug 88. The core is then withdrawn from the end of the knob and the knob sleeve, together with the face plate 108, leaving the knob in place on the sleeve. The core 80 and the face plate 108 are then simply inverted and reinserted in the end of the knob 50 and into the knob sleeve 52. It is a special advantage of the present invention that the core 80 and the face plate 108 are receivable in the knob and the knob sleeve 52 in either orientation, so that the lock set is adapted for installation in doors of either hand with a minimum of effort and without any modification of the structure and without requiring removal or rotation of the knob 50.

The installed lock set provides high security against tampering or forceful attack. The lock is clamped in the door by clamp screws 222 which are totally concealed and which are accessible only by removing the inside knob 150 and inside escutcheon 225. While these are easily removed for service as necessary, the mounting of the lock set in the door is secure against tampering from the outside of the door. Further, the outside knob 50 cannot be removed without first removing the key controlled core 80. The keeper 60 which retains the outside knob 50 in place on the knob sleeve 52 is blocked from retraction by the cylindrical shank 64 of the throw member 66 as long as that throw member is in place and held against removal by a core 80. To remove the outer knob 50, it is necessary first to remove the core 80 by means of the control key 90, and to withdraw the throw member 66. The keeper 60 can then be thrust inward by a release tool inserted through the access hole 63 in the side of the knob, to release the keeper from engagement with the retaining rib 58, and the knob may then be withdrawn axially from the knob sleeve 52.

The outside assembly strongly resists forceful attack. The knob sleeve 52 is a heavy-walled part of tubular configuration. While it is desirably made from a flat stamping rolled and shaped to the desired configuration, the meeting edges of the stamping from which it is made are interlocked by tongue and groove connections, as shown in FIG. 7, in which the tongues have at least a slight dove-tail configuration and a press fit in the grooves which receive them. The meeting edges are thus locked against displacement to form a strong tubular part.

The knob sleeve 52 is securely held in the outside hub 10 of the chassis, in part by the out-turned roll back cam 110 which bears against the inner end of the hub 10, and in part by the out-turned lug 140 which rides in the rabbet groove 142 in the end of that hub 10 and is displaced a substantial distance circumferentially from the roll back cam 110.

The lock set as shown and described has a conventional operating function, commonly designated in the trade as an A function. In such function, with the turn button 172 in retracted position as shown in full lines in FIG. 1, the retractor may be operated to retract the bolt by turning either knob in either direction. Referring to FIG. 3, if the outside knob is turned to rotate the knob sleeve 52 in a counter-clockwise direction as viewed in FIG. 3, this carries the roll back cam 110 against the retractor face 42 to retract the retractor. If the knob is turned to rotate the sleeve 52 clockwise as viewed in FIG. 3, the knob roll back cam 110 is thrust against the key release roll back cam 114 to rotate that cam clockwise and similarly retract the retractor.

The outside knob is locked against rotation by manually pushing the turn button 172 inward and turning it 90°. The ears 180 on the locking bar 174 then become engaged in the detent plate 177 to hold the bar and the button in actuated position. This actuation of the locking bar 174 moves the bushing 122 to the left in FIG. 1 to carry the locking lug 127 to its locking position shown in dotted lines in FIG. 1, where it lies in the notch 132 of the outside knob sleeve 52 and locks that sleeve to the hub 10. The inside knob remains operative to retract the bolt. The bolt may then be retracted from outside the door only by means of a proper operating key. The key is inserted in the key plug 77 of the core 80 and turned counter-clockwise as viewed from the front of the knob. This rotates the throw member 64 and the cam carrier 112 to carry the key-actuated roll back cam 114 against the retractor (clockwise in FIG. 3) to retract the retractor and the bolt. As the cam 114 moves, it passes over the retaining lug 140 which lies in the groove 142 in a different plane from that of the cam. The outside knob may be released from locked condition by pushing the turn button 172 inward to disengage the ears 180 from the detent plate 177, turning the button 90°, and releasing it to its normal position, which action moves the locking lug 127 back to its release position as shown in full lines in FIG. 1.

Figure 10:
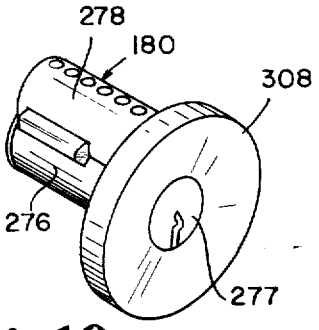
FIG. 10 is an isometric view of an alternative round-faced core unit which combines the core and face plate.

In the round face core unit shown in FIG. 10, the core and face plate are combined in a single unit. This comprises a core portion 280 having a body cylinder 276 and a pin tumbler section 278. The body cylinder 276 contains a key plug 277. The core portion 180 is rigidly fixed to a round face plate portion 308 which has a single central opening on the axis of the body cylinder 276, through which the key plug 277 is exposed. This round-faced core assembly can be substituted directly for the separate core 80 and face plate 108 shown in FIG. 6.

In the modification shown in FIG. 11 and 12, a face plate 408 is rigidly fixed in the bore 68 of the knob 50. The face plate 408 as shown is a metal stamping having a front wall 410 and a cylindrical side wall 412 which has a beveled face 414 at its free edge. The knob 50 is identical with that shown in FIG. 1, except that a groove 416 is formed opposite the peripheral edge of the drive ring 98. The drive ring 98 is preferably provided with a slight bevel at the front edge of its periphery, and it is found that when the drive ring 94 is formed as a sheet metal stamping, the "drawdown" which occurs at the edge of the stamping is sufficient to form the desired bevel.

The face plate 408 has a central opening 409 of figure-8 shape, like the opening 109 shown in the face plate 108 in FIG. 6.

In assembly of the modification of FIGS. 10 and 11 a drive ring 98 is first inserted in the knob bore 68 and seated against the shoulder 94 with its lugs 100 engaged in the broached slots 96, in the same way as in FIG. 1. A face plate 408 is inserted in the knob bore 68 in an orientation with its figure-8 opening in registry with one of the extensions 107 of the central opening of the drive ring, to the position shown in FIG. 11. Its bevel face 414 will then engage the peripheral edge of the drive ring 98. The face plate 408 is then pressed inward, and this causes its peripheral edge to be flared out into the groove 416 as such edge is forced past the edge of the drive ring, as shown at 418 in FIG. 12. This positively locks the face plate 408 in the knob, and secures the drive ring 98 in place in the knob.

This face plate arrangement is used in the same way as that shown in FIGS. 1–9. When the knob 50 is mounted on the knob sleeve 52, the figure-8 shaped opening 409 of the fixed face plate 408 receives the core 80 in the same relation to the other parts as shown in FIG. 6, and the only difference is that the face plate 108 and the drive ring 98 are fixed in the open end of the knob 50, and have a fixed orientation in that knob rather than being rotatable therein as is the case with the face plate 108 shown in FIGS. 1–9.

When it is desired to reverse the "hand" of the knob 50 containing a fixed face plate 408, it is first necessary to remove the core 80, as before. The knob 50 is then released from its retained position on the knob sleeve 52, by depressing the knob retainer 60 to release it from engagement with the internal rib 58 of the knob neck, and the knob is withdrawn a short distance, sufficient to release the engagement between the drive ring 98 and the knob sleeve 52, and the knob is then rotated 180° and re-engaged with the knob sleeve 52 and re-secured in retained position by the knob retainer 60. This rotation of the knob positions the figure-8 shaped opening 409 of the face plate 408 in a new orientation, 180° from its original orientation, and permits insertion of the core 80 through the newly-oriented knob and face plate 408 in a new orientation relative to the lock chassis, in the same manner as before.

We claim:

1. A cylindrical lock, comprising a chassis having a hub, a tubular knob sleeve rotatably mounted in said hub and adapted to receive a key actuated lock core having a cylindrical body containing a key plug and having a pin-tumbler section extending laterally from said body, said sleeve being of substantially larger diameter than said lock core body and having at its outer end two opposite lengthwise slots, the material between such slots being formed as channel sections each having an outer web portion and side legs bent at an angle to said web portion and extending inward therefrom, the inner ends of the channel side legs being shaped and positioned to form longitudinal mounting ribs spaced about the axis of the sleeve to slidably receive and support the smaller body of the key-actuated lock core coaxially with the larger sleeve, at least one of the said slots being shaped to pass the pin-tumbler section of the lock core.

2. A cylindrical lock as in claim 1 in which said channel sections are symmetrical about the sleeve axial and diametrically opposed, and said two slots are both shaped to pass the pin-tumbler section of the lock core, so as to permit the core to be mounted in the sleeve in either of two orientations therein.

3. A cylindrical lock as in claim 2 in which the lock core is a key-removable lock core having a key-retractable retaining lug extending laterally therefrom, each of said channels having at least one leg notched to form a rearward facing shoulder for engagement with the retaining lug of the core to retain the same against removal from the sleeve.

4. A cylindrical lock as in claim 2 in which the lock is a key-removable core of figure-8 cross section having a key plug lobe and a pin-tumbler lobe defining V-grooves at the sides of the core, and having a key-retractable retaining lug projecting from the core at the bottom of one of said grooves, the side legs of said opposed channels being formed at their inner edges to seat in said grooves at the sides of the core, and one of the legs on each channel being notched to receive said retaining lug and to form a rearward facing shoulder to engage such lug to retain the core against removal from the sleeve.

5. A cylindrical lock as in claim 1 with the addition of a knob mounting concentrically over said knob sleeve, said knob having an outer circular opening of a radius sufficient to clear the pin-tumbler section of a lock core mounted in the sleeve, and a locating ring engaged about the end of said knob sleeve and within said knob opening to locate the knob concentrically with the sleeve, said ring having an opening to pass the pin-tumbler section of the core.

6. A cylindrical lock as in claim 5 in which said locating ring has interengaging means by which it is keyed to the knob sleeve and to the knob to transmit torque therebetween.

7. A cylindrical lock, comprising a chassis having a hub, a tubular knob sleeve rotatably mounted in said hub and adapted to receive a key actuated lock core having a body containing a key plug and having a pin-tumbler section extending laterally from said body, said sleeve at its outer end having two opposite lengthwise slots, the material between such slots being formed as channel sections each having an outer web portion and side legs bent at an angle to said web portion and extending inward therefrom, the inner ends of the channel side legs being shaped and positioned to form longitudinal mounting ribs spaced about the axis of the sleeve to slidably receive and support in the spindle the body of the key-actuated lock core, said channel sections being symmetrical about the sleeve axis and diametrically opposed, and said two slots being both shaped to pass the pin-tumbler section of the lock core, so as to permit the core to be mounted in the sleeve in either of two orientations therein, a knob mounted concentrically over the knob sleeve, said knob having an outer circular opening of a radius sufficient to clear the pin-tumbler section of a lock core mounted in said sleeve in both of its two orientations therein, and a locating ring engaged about said sleeve and within said knob opening to locate the knob concentrically with the sleeve, said ring having two opposite side openings to pass the pin-tumbler section of the core in both of its two orientations in the sleeve, and means to retain the core in place in the sleeve and knob in both such orientations, said parts being arranged to permit removal andn insertion of the core in each orientation while the knob remains mounted on the sleeve.

8. A cylindrical lock as in claim 7 in which said locating ring is keyed to the knob sleeve and to the knob to transmit torque therebetween.

9. A cylindrical lock as in claim 7 with the addition of a face plate to close the outer end of said circular opening in the knob, said face plate having an opening to pass the core in a single orientation and being insertable in two orientations in the knob opening to suit the orientation of the core in the knob and sleeve.

10. A cylindrical lock, comprising a chassis having a hub, a tubular knob sleeve rotatably mounted in said hub and adapted to receive a key-actuated lock core having a cylindrical body containing a rotatable-key plug and having a pin-tumbler section extending laterally from the body, said sleeve being of substantially larger diameter than the cylindrical body of the core, said sleeve at its outer end having a plurality of lengthwise slots therein, the material between such slots being formed as channel sections having web portions at the periphery of the sleeve and having side walls bent inward and extending to a position to engage the body of the core, said side walls together forming a cage to slidably receive the core body and support the same coaxially with the substantially larger sleeve, at least one of said slots being shaped to pass the pin-tumbler section of the lock core.

11. A cylinder lock comprising a chassis having a hub, a tubular knob sleeve rotatably mounted in the hub and projecting beyond its end, a knob mounted over the sleeve and hub, said knob having a circular opening in its outer end of substantially larger diameter than said sleeve, a locating ring engaged about the end of the knob sleeve and within the circular opening of the knob to locate the knob coaxially with the sleeve, the locating ring having interlocking means, engaged with both the sleeve and knob to key the same to the ring and against relative rotation so as to transmit torque therebetween.

12. A cylindrical lock as in claim 11 in which the locating ring has a central opening defined by an inner periphery closely surrounding the sleeve and has a plurality of tongues extending inward from said periphery and engaged in notches in the sleeve to locate the ring both rotationally and axially on the sleeve.

13. A cylindrical lock as in claim 11 in which said knob opening has an outwardfacing shoulder intermediate its length and axial grooves extending therefrom, and said ring has an outer periphery which rests on said shoulder and has tabs at such periphery which enter said grooves so as to locate the ring both rotationally and axially in said knob.

14. A cylindrical lock as in claim 11 with the addition of a face plate mounted about the end of the knob sleeve in said knob opening to close said opening, and means to retain the face plate in place.

15. A cylindrical lock comprising a chassis having a hub, a tubular knob sleeve rotatably mounted in the hub and projecting beyond its end, a knob mounted over the sleeve and hub and means at the outer end of the knob interengaged with the sleeve and supporting the knob coaxially with the sleeve and against relative rotation thereon, said knob having a neck which extends inward and is telescopically received over the hub in rotatable bearing relation therewith and which carries an internal rib bearing against the end of the hub.

16. A cylindrical lock as in claim 15 with the addition of a knob keeper mounted in said knob sleeve and having a keeper lug engaged with said internal rib in the knob neck.

17. A cylindrical lock as in claim 16 in which the axially-inward face of said internal rib and the axially-outward face of said knob keeper are bevelled so as to cause the keeper to retract and allow the rib to pass when the knob neck is thrust on to the sleeve.

18. A cylindrical lock comprising a chassis having a hub, a tubular knob sleeve rotatably mounted in said hub and adapted to receive a key-removable lock core having a body portion of smaller diameter than said sleeve and containing a rotatable key plug, said sleeve having a rear cylindrical portion rotatably received in said hub, an intermediate transition portion, and a front portion formed as two channel sections having outer web portions of cylindrical configuration and elongated, inward-extending side legs which at their inner edges define an elongated cage for slidably receiving and supporting said lock core with its key plug coaxial with the sleeve, a roll back cam on the sleeve, a key-actuated roll back carrier rotatably mounted in the cylindrical rear portion of the sleeve and having a roll back cam thereon, and a throw member extending across the intermediate portion of the sleeve and arranged for support by and between said key plug at the front and said roll back carrier at the rear for transmitting key-actuated rotation of the key plug to said roll back carrier.

19. A cylindrical lock comprising a chassis having a hub, a tubular knob sleeve rotatably mounted in said hub and adapted to receive a key-removable lock core having a body portion of smaller diameter than said sleeve and containing a rotatable key plug, the outer end of said sleeve being formed as two channel sections having elongated, inward-extending side legs which at their inner edges define an elongated cage for slidably receiving and supporting said lock core with its key plug coaxial with the sleeve, a roll back cam on the sleeve, a key-actuated roll back carrier rotatably mounted in the sleeve and having a roll back cam thereon, a throw member supported by and between said key plug at the front and said roll back carrier at the rear for transmitting key-actuated rotation of the key plug to said roll back carrier, a knob mounted about said sleeve and having a neck telescoped over said hub, a knob keeper mounted in said sleeve adjacent the outer end of said roll back carrier and having a keeper lug engaged with said neck, and a cylindrical shank on said throw member positioned in the path of retraction of said knob keeper to block retraction thereof, and thereby prevent knob removal, the throw member being removable with the key-removable lock core is removed, to thereby allow keeper retraction to release the knob for removal.

20. A cylindrical lock comprising a chassis having a tubular hub including an out-turned flange at its inner end, a tubular knob sleeve rotatably mounted in said hub and having an out-turned knob-actuated roll back cam at its inner end bearing against the inner end of the hub, a key-actuated roll back carrier rotatably mounted in the sleeve and having a key-actuated roll back cam at its inner end, an out-turned retaining lug on said knob sleeve at a point spaced angularly from said roll back cam thereon and bearing against a face on said hub, said lug and said roll back cam co-acting to retain the sleeve against outward axial pull.

21. A cylindrical lock as in claim 20 in which said hub has a rabbet groove extending circumferentially at its inner end and said out-turned lug rides in said groove.

22. A cylindrical lock as in claim 20 in which said two roll back cams are substantially coplanar, said hub has a rabbet groove extending circumferentially thereof at its inner end in a plane displaced from the plane of said cams, and said out-turned lug rides in said groove out of the plane of the key-actuated roll back cam, said knob-actuated roll back cam and said retaining lug being normally on opposite sides of the position of the key-actuated roll back cam.

23. A cylindrical lock comprising a chassis having inner and outer threaded hubs joined at their inner ends to side plates, a frame member between the side plates, and means securing the side plates against the sides of the frame member with portions of the side plates projecting radially beyond the frame member in spaced relation, a combined escutcheon and clamp plate threaded on the outside hub and adapted to bear against the outside face of a door, an inside clamp plate loosely surrounding the inside hub for engaging the inside face of the door and bolts for drawing such plate toward the chassis so as to cause the two clamp plates to be drawn together to clamp the combined escutcheon and clamp plate against the face of the door and thereby secure the chassis to the door, locking means acting between the projecting portions of the side plates of the chassis and the combined escutcheon and clamp plate to lock the latter against rotation on its hub, and an inside escutcheon threaded on the inside hub and covering the inside claim plate.

24. A cylindrical lock as in claim 23 with the addition of a knob sleeve rotatably mounted in each of said hubs, and a knob mounted on each sleeve, each knob having a neck portion telescopically received over and enclosing the outer end of the hub on which it is mounted, and the escutcheon on each such hub having a collar telescoped over the neck of the knob so as to form a single joint between the escutcheon and the knob.

25. A cylindrical lock as in claim 23 with the addition of a resilient locking ring mounted between the clamping plate and the inside escutcheon to lock said escutcheon in adjusted position.

26. A cylindrical lock comprising a chassis having inner and outer threaded hubs jointed at their inner ends to side plates, a frame member between the side plates, and means securing the side plates against the sides of the frame member with portions of the side plates projecting radially beyond the frame member in spaced relation, a combined escutcheon and clamp plate threaded on the outside hub and adapted to bear against the outside face of a door, an inside clamp plate for engaging the inside face of the door and bolts for drawing such plate toward the chassis so as to cause the two clamp plates to be drawn together to clamp the chassis to the door, locking means acting between the projecting portions of the side plates of the chassis and combined escutcheon and clamp plate to lock the latter against rotation on its hub, and an inside escutcheon threaded on the inside hub and covering the inside clamp plate, said locking means comprising a plunger pin slidably mounted in the projecting portions of the side plates and biased toward a locking position of engagement with said combined escutcheon and clamp plate, the latter having an annular series of openings therein into which said plunger pin extends in locking position, and latching means to latch said plunger pin in retracted position to permit free threaded adjustment of said clamp plate to suit the thickness of the door in which the lock is to be installed.

27. A cylindrical lock as in claim 26 in which the latched positon of the plunger pin disposes its end in interference relation with said inside clamp plate so as to ensure release of the pin to locking position prior to installation of such inside clamping plate.

28. A cylindrical lock comprising a chassis having a hub, a tubular knob sleeve rotatably mounted in said hub, a key actuated lock core having a body containing a key plug and having a pin tumbler section extending laterally from said body, said core having a key-actuable retaining lug movable between a retracted core-releasing position and a laterally-projected core-retaining position, said knob sleeve at its outer end being formed as two diametrically-opposite arms spaced to receive between themselves the body of the core and circumferentially separated by two opposite slots of a width to pass the pin tumbler section of the core, the arms and slots being symmetrical with respect to a diametrical plane so as to permit the lock core to be mounted therein in two opposite orientations to suit right- and left-hand doors, two inward-facing shoulders fixed with respect to said sleeve arms and respectively positioned for engagement by the retaining lug of the lock core and to retain said core in mounted position in such two orientations, said knob sleeve being of substantially large diameter than the body of the lock core and said sleeve arms lying on such larger diameter, and spacing means supported by said sleeve arms and engaging said core body to mount the body co-axially in the sleeve, said sleeve arms being in the form of channel sections and said spacing means being provided by the side legs of such channel sections.

29. A cylindrical lock core as in claim 28 in which said inward facing shoulders are formed on the side legs of the channel-section sleeve arms.

* * * * *

UNITED STATES PATENT OFFICE

CERTIFICATE OF CORRECTION

Patent No. 3,955,387 Dated May 11, 1976

Inventor(s) Walter E. Best and R. Gene McCullum

It is certified that error appears in the above-identified patent and that said Letters Patent are hereby corrected as shown below:

Column 1, line 41, change "rectractor" to --retractor--;
line 42, change "mouonted" to --mounted--;
line 47, change "cylindrically" to --cylindrical--.
Column 3, line 50, change "ffame" to --frame--;
line 65, change "390,857" to --390,847--.
Column 5, line 12, change "not" to --now--.
Column 6, line 67, after "thereby" insert --locked--.
Column 7, line 51, change "two-" to --two out- --.
Column 11, line 20, after "lock" insert --set--.
Column 13, line 57, change "axial" to --axis--.
Column 14, line 1, add --core-- after "lock" at the end of the line;
line 14, change "mounting" to --mounted--;
line 63, change "andn" to --and--.
Column 15, line 37, delete the comma after "means";
line 49, change "outwardfacing" to --outward-facing--.
Column 17, line 50, change "claim" to --clamp--.
Column 18, line 12, before "combined" insert --the--;
line 56, change "large" to --larger--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*